US011353289B2

(12) United States Patent
Walker et al.

(10) Patent No.: US 11,353,289 B2
(45) Date of Patent: Jun. 7, 2022

(54) ZERO-STOP TURRET

(71) Applicant: Deben Group Industries Limited, Woodbridge (GB)

(72) Inventors: Stephen Andrew Walker, Ipswich (GB); Alexander George Jenkinson, Woodbridge (GB)

(73) Assignee: Hawke Optics Limited, Woodbridge (GB)

( * ) Notice: Subject to any disclaimer, the term of this patent is extended or adjusted under 35 U.S.C. 154(b) by 0 days.

(21) Appl. No.: 17/423,249

(22) PCT Filed: Jan. 17, 2020

(86) PCT No.: PCT/IB2020/050368
§ 371 (c)(1),
(2) Date: Jul. 15, 2021

(87) PCT Pub. No.: WO2020/148714
PCT Pub. Date: Jul. 23, 2020

(65) Prior Publication Data

US 2022/0090879 A1 Mar. 24, 2022

(30) Foreign Application Priority Data

Jan. 17, 2019 (GB) ..... 1900665

(51) Int. Cl.
*F41G 1/38* (2006.01)
*G05G 1/10* (2006.01)
(Continued)

(52) U.S. Cl.
CPC ..... *F41G 1/38* (2013.01); *F41G 1/387* (2013.01); *F41G 1/44* (2013.01); *F41G 1/545* (2013.01); *G05G 1/10* (2013.01)

(58) Field of Classification Search
CPC ... F41G 1/38; F41G 1/387; F41G 1/44; F41G 1/545; G05G 1/10
(Continued)

(56) References Cited

U.S. PATENT DOCUMENTS 5,513,440 A 5/1996 Murg
6,508,144 B1 1/2003 Vendetti et al.
(Continued)

FOREIGN PATENT DOCUMENTS

CN 101545741 A 9/2009
CN 101666593 A 3/2010
(Continued)

OTHER PUBLICATIONS

International Search Report and Written Opinion (Application No. PCT/IB2019/050368) dated Mar. 24, 2020.
(Continued)

*Primary Examiner* — Samir Abdosh
(74) *Attorney, Agent, or Firm* — Burr & Brown, PLLC

(57) ABSTRACT

A zero-stop mechanism comprises first and second stop members and a movement limit member. The second stop member is releasably secured to an adjustment mechanism. The movement limit member extends around a turret assembly and has a substantially annular main body from which a lug extends. In a first rotational direction of the adjustment mechanism, the second stop member comes into contact with a first side of the lug whereby the main body is rotated in the first rotational direction until a second side of the lug comes into contact with the first stop member. In a second rotational direction of the adjustment mechanism, the second stop member comes into contact with the lug second side whereby the main body is rotated in the second rotational direction until the lug first side contacts the first stop member.

31 Claims, 6 Drawing Sheets

(51) Int. Cl.
*F41G 1/387* (2006.01)
*F41G 1/44* (2006.01)
*F41G 1/54* (2006.01)

(58) Field of Classification Search
USPC ..... 42/125
See application file for complete search history.

(56) References Cited

U.S. PATENT DOCUMENTS

| | | | |
|---|---|---|---|
| 6,691,447 | B1 | 2/2004 | Otteman |
| 2003/0140545 | A1 | 7/2003 | Huber |
| 2008/0007843 | A1 | 1/2008 | Schafer |
| 2008/0016748 | A1 | 1/2008 | Murg et al. |
| 2008/0066364 | A1 | 3/2008 | Klepp et al. |
| 2008/0236018 | A1 | 10/2008 | Halverson |
| 2008/0289239 | A1 | 11/2008 | Menges et al. |
| 2009/0044660 | A1 | 2/2009 | Bonis |
| 2009/0199452 | A1 | 8/2009 | Huber |
| 2010/0175298 | A1 | 7/2010 | Thomas et al. |
| 2011/0061285 | A1 | 3/2011 | Hamilton |
| 2011/0100152 | A1 | 5/2011 | Huynh |
| 2011/0102918 | A1 | 5/2011 | Windauer |
| 2011/0261449 | A1 | 10/2011 | Schmitt |
| 2012/0144719 | A1 | 6/2012 | Huber |
| 2012/0147488 | A1 | 6/2012 | Riley |
| 2012/0154907 | A1 | 6/2012 | Schmitt et al. |
| 2012/0167444 | A1 | 7/2012 | Adkins et al. |
| 2013/0167425 | A1 | 7/2013 | Crispin |
| 2013/0232846 | A1 | 9/2013 | Wagner et al. |
| 2013/0276345 | A1 | 10/2013 | Hamilton |
| 2013/0312310 | A1 | 11/2013 | Geller |
| 2014/0137458 | A1 | 5/2014 | Crispin |
| 2014/0196351 | A1 | 7/2014 | Campcan |
| 2015/0070758 | A1 | 3/2015 | Ingenito |
| 2015/0146289 | A1 | 5/2015 | Ingenito et al. |
| 2015/0153138 | A1 | 6/2015 | Presley et al. |
| 2015/0316350 | A1 | 11/2015 | Hamilton |
| 2016/0040959 | A1 | 2/2016 | Davidson et al. |
| 2016/0169672 | A1 | 6/2016 | Öttl et al. |
| 2016/0178323 | A1 | 6/2016 | Öttl |
| 2017/0191797 | A1 | 7/2017 | Lassak et al. |
| 2017/0205195 | A1 | 7/2017 | Sheets, Jr. et al. |
| 2017/0328674 | A1* | 11/2017 | VanBecelaere ..... G02B 27/36 |
| 2019/0128642 | A1* | 5/2019 | Davis ..... F41G 1/38 |
| 2019/0376765 | A1* | 12/2019 | Hamilton ..... G02B 7/023 |
| 2020/0232762 | A1* | 7/2020 | Hamilton ..... G02B 27/0189 |
| 2020/0386259 | A1* | 12/2020 | McDermot ..... F16B 33/02 |

FOREIGN PATENT DOCUMENTS

| | | | | |
|---|---|---|---|---|
| CN | 204705266 | U | 10/2015 | |
| CN | 205300392 | U | 6/2016 | |
| CN | 205373522 | U | 7/2016 | |
| CN | 106288955 | A | 1/2017 | |
| CN | 206430638 | U | 8/2017 | |
| CN | 207081374 | U | 3/2018 | |
| CN | 207113716 | U | 3/2018 | |
| DE | 203 01 749 | U1 | 4/2003 | |
| DE | 10 2011 013 456 | A1 | 9/2012 | |
| DE | 20 2012 012 707 | U1 | 11/2013 | |
| GB | 2489783 | A | 10/2012 | |
| JP | 2004-150699 | A1 | 5/2004 | |
| WO | 2017/132316 | A1 | 8/2017 | |
| WO | WO-2017132316 | A1 * | 8/2017 | ..... F41G 1/38 |
| WO | 2018/096475 | A1 | 5/2018 | |
| WO | WO-2020146385 | A9 * | 8/2020 | ..... F41G 1/38 |

OTHER PUBLICATIONS

GB Search Report (Application No. 1900665.9) dated Jul. 12, 2019.

* cited by examiner

ZERO-STOP TURRET

FIELD OF THE INVENTION

This disclosure relates to a zero-stop turret for a firearm sight. In one embodiment, the disclosure relates to a zero-stop turret mounted to a housing of a telescopic sight of a firearm.

BACKGROUND TO THE INVENTION

Telescopic sights for firearms, for example a pistol or rifle, typically have a tubular external housing and a pair of manually adjustable sighting mechanisms including a manual adjustment control mounted on the housing, one for adjusting windage and the other for adjusting elevation. Such a telescopic sight will have an optical system housed by the housing, which comprises opposite objective and eyepiece lenses and in between these lenses within the housing a sighting element, typically either a wire reticle or an etched reticle, bearing a graphic image pattern that is optically arranged with respect to the objective and eyepiece lenses, such that the graphic image pattern provides the aiming point in a telescopic image generated by the objective and eyepiece lenses.

The manual adjustment controls are usually part of a generally cylindrical assembly, referred to as a turret assembly or simply as a turret. The elevation turret has a rotatable elevation knob which, when turned, causes the aiming point to move up or down, and the windage turret has a rotatable windage knob which, when turned, causes the aiming point to move left or right.

Telescopic sights are normally equipped with a parallax compensation mechanism which essentially consists of a movable optical element that enables the optical system to project a telescopic image of objects at varying distances and a graphic image provided by the reticle together in exactly the same optical plane. The optical system between the objective and eyepiece lenses normally includes an erector lens so that the eyepiece image is correctly oriented and not inverted. Therefore, there are normally two focal planes inside the housing along an optical axis defined by the objective and eyepiece lenses, a front focal plane or a rear focal plane, and the sighting element may be located at either of these focal planes. On fixed power telescopic sights there is no significant difference between these two options, but on variable power telescopic sights the front plane location remains at a constant size compared to the target, while the rear plane location appears as a constant size to the user as the target image grows and shrinks. There are other advantages and disadvantages for both locations, however, the choice of location for the sighting element is not central to the present invention.

Usually, the sighting element and/or other associated internal optical components, such as an erector lens, are held by a movable mount inside the housing, most commonly a tube that has an axis that extends in substantially the same direction as the optical axis of the telescopic lens system The manual adjustment controls are arranged to move the movable mount, and hence the sighting element and/or other associated internal optical components in orthogonal directions in order to generate an apparent movement of the reticle image in the telescopic image, thereby adjusting the aiming point. The movable mount is often arranged to pivot at one end, and depending on the location of the sighting element in either the front or rear focal plane, the sighting element may move with the movable mount, or may remain substantially fixed in place while other associated optical components, such as an erector lens, move with the movable mount. However, the particular mounting and movement arrangement of the sighting element and/or other associated internal optical components is not central to the invention.

Each rotatable turret knob is linked to an actuator including a linkage mechanism and a plunger which extends to the interior of the housing. Together, the rotatable turret knob and linkage mechanism provide a manual adjustment control for making a sighting adjustment. The linkage mechanism converts the rotational movement of the turret knob to movement of the plunger to cause a corresponding shift in the transverse orientation of the sighting element and/or other associated internal optical components. So that a user can judge how far to turn each knob, the manual adjustment mechanism usually comprises a click-stop mechanism to quantize the rotation and hence movement of the plunger and the corresponding adjustment to the aiming point. The user can usually both hear and feel a click detent mechanism as the turret knob is turned from one click-stop position to the next. Different types of telescopic sights have different gradations in movement, and these are normally marked off in increments on a scale that extends circumferentially around the turret knob, or may alternatively be printed on a non-rotating part of the turret or scope housing closest to the turret knob.

For example, a telescopic sight intended for air guns or small bore rim fire rifles will have an adjustment mechanism in which each single click of adjustment will change the aiming point by ¼ minute of angle (MOA), which at a range of 100 yards (91.7 m) is approximately ¼" (6.4 mm). In general, target or long range telescopic sights may have finer graduations than this and hunting telescopic sights may have coarser graduations than this. An example of a coarser gradation would be an adjustment mechanism in which each single click of adjustment will change the aiming point by 1 milliradian of angle (mrad), which at a range of 100 yards (91.7 m) is approximately ⅓" (9.1 mm).

Adjusting the sight allows a user to place an aiming feature of the reticle, such as a crosshair, directly on their intended point of impact without having to "hold over" the target for trajectory (or bullet drop) compensation.

Conventional turret knobs have markings on them that indicate how many clicks of adjustment have been dialled in on the turret, or an angular deviation, or a distance compensation for a given cartridge. Turret knobs are normally marked at each graduation, starting with "0" (zero) and increasing as the turret knob is turned. Sometimes, turrets can rotate more than one revolution. A problem then arises in that the scale repeats itself every revolution, which can result in confusion as to the number of rotations from a true zero setting of the turret correct for a particular distance for which the elevation has been sighted.

Aa an example, a turret knob may provide 10 mrad of adjustment over one full revolution. This may be graduated in 0.1 mrad increments, for a total of 100 increments on a scale and 100 corresponding click-stop positions. As a result, the user would see the digits 0 through 9 around turret knob and 10 mrad would be a full rotation back to the zero position. Turning beyond this then necessitates remembering the number of full turns when the turret knob is to be rotated back to its original setting.

For very long range shots, one may need to dial 40 mrad or more of compensation to compensate for bullet drop, and so turret knobs may need to provide to 4 full turns before mechanically running out of total rotational travel. The alternative, of click-stop increments being closer together makes it difficult to read the scale and to feel a definite click at each increment. Although this problem can be dealt with to some extent by increasing the diameter of the turret knob, it is normally desirable for scopes to be small, streamlined, and lightweight.

In addition, it is common when installing a new riflescope onto a rifle to "zero" the rifle. There are also many smartphone apps and other devices that can aid a shooter in calculating their ballistic compensation for a given range and environment, which can then be dialled into the turret knob. For example, a .308 calibre (7.82 mm) at a 1000 yard (914.4 m) shot may need to have 8.7 mrad compensation to place the crosshair in the correct spot in the riflescope in order to compensate for the drop of the bullet. After shooting at a long range target, a shooter will normally dial the turret "0" position, and sometimes this may need to be done quickly if there is a "target of opportunity" at a closer range.

For these reasons it is desirable to have a "zero-stop" turret, i.e. one that can be turned to a position in which there is a stop against further rotation, and one in which preferably the zero-stop position is also adjustable, so that it can be set according to the distance chosen when sighting the rifle scope reticle against a target.

It is an object of the invention to provide a convenient turret comprising a zero-stop mechanism, a method of setting such a zero-stop mechanism and a method of setting a zero-stop of a sighting adjustment turret to limit an adjustment range of a sighting element of a telescopic sight.

SUMMARY OF THE INVENTION

According to a first aspect of the invention, there is provided a turret for a telescopic sight, comprising a turret assembly and affixed externally to the turret assembly a turret knob, wherein:

the turret assembly comprises:

a base portion, the base portion having a seat for fixing the turret assembly to an aperture in a housing of a telescopic sight;

a plunger extending along an axis of the turret within the base portion, and being movable along said axis for actuating a movable member within said housing;

an adjustment mechanism linked to the plunger, the adjustment mechanism being rotateably mounted to the base portion and being configured, in use, to drive axial movement of the plunger along said axis; and the turret knob is attached to the adjustment mechanism whereby, in use, a user can turn the turret knob to effect rotation of the adjustment mechanism in opposite first and second rotational directions, to move the plunger axially in opposite first and second axial directions by manually turning the turret knob in corresponding rotational directions;

wherein the turret assembly further comprises a zero-stop mechanism for limiting the rotation of the adjustment mechanism in both rotational directions, wherein the zero-stop mechanism comprises:

a first stop member for limiting rotation of the adjustment mechanism, the first stop member being fixed to the base portion;

a second stop member for limiting rotation of the adjustment mechanism, the second stop member being releasably secured to the adjustment mechanism whereby the second stop member when secured to the adjustment mechanism is rotationally carried by rotational movement of the adjustment mechanism and when released from the adjustment mechanism is freed from being carried by said rotational movement;

a movement limit member extending around the turret assembly, the movement limit member comprising: (i) a substantially annular main body, said main body being rotatable about said axis with respect to both the base portion and the adjustment mechanism; and (ii) a lug extending away from said main body and being guided by said rotation of said main body along a circular path, and the lug having a first side and opposite the first side, a second side, and wherein, the configuration of the lug, the first stop member and the second stop member when rotationally secured to the adjustment mechanism is such that:

in the first rotational direction the second stop member comes into contact with the first side of the lug whereby said main body is rotated in the first rotational direction by the lug as the lug is moved along the circular path by the second stop member until the second side of the lug comes into contact with the first stop member, thereby limiting the rotation of the adjustment mechanism in the first rotational direction; and in the second rotational direction the second stop member comes into contact with the second side of the lug whereby said main body is rotated in the second rotational direction by the lug as the lug is moved along the circular path until the first side of the lug comes into contact with the first stop member, thereby limiting the rotation of the adjustment mechanism in the second rotational direction; and wherein, the configuration of the lug, the first stop member and the second stop member when rotationally released from the adjustment mechanism is such that the adjustment mechanism is freed from said rotational limits of the zero-stop mechanism.

According to a second aspect of the invention, there is provided a telescopic sight comprising:

an elongate external housing of generally cylindrical shape providing a sealed enclosure for optical components held within the housing between opposite objective and eyepiece ends of the housing, said optical components comprising an adjustable sighting assembly;

a turret mounted externally on a central portion of the housing, the turret being according to the first aspect of the invention, wherein the plunger extends along the axis of the turret within the base portion of the turret assembly, and is movable along said axis to actuate a movable member of the adjustable sighting assembly within the housing.

According to a third aspect of the invention, there is provided a method of setting a zero-stop to limit the rotation in both directions of rotation of an adjustment mechanism of a turret for a telescopic sight, the turret being according to the first aspect of the invention, and the method comprising:

releasing the second stop member from the adjustment mechanism so that the second stop member is freed from being carried by rotational movement of the adjustment mechanism;

making a desired sighting adjustment of a telescopic scope;

adjusting the rotational position of the second stop member with respect to the adjustment mechanism in either the first direction of rotation or the second direction of rotation until the first side of the lug comes into contact with one of the first and second stop members and the second side of the lug comes into contact with the other one of the first and second stop members;

securing the second stop member to the adjustment mechanism so that the second stop member will rotate in unison with the adjustment mechanism about the axis of the turret and thereby setting in one direction of rotation a first rotation limit corresponding to the desired sighting adjustment, a second rotation limit in the other direction of rotation being set by contact between the lug and both the first and second stop members after more than one full turn of the adjustment mechanism and less than two full turns of the adjustment mechanism.

According to a fourth aspect of the invention, there is provided a method of setting a zero-stop of a sighting adjustment turret to limit an adjustment range of a sighting element of a telescopic sight, said turret comprising a turret assembly and a turret knob removeably affixed externally to the turret assembly, the turret assembly comprising:

a base portion fixed to said telescopic sight;

an adjustment mechanism that is rotatable in opposite first and second rotational directions around a turret axis and which is linked to a plunger that is movable in opposite first and second axial directions in response to rotation of the adjustment mechanism in, respectively, said first and second rotational directions; and a zero-stop mechanism for limiting the rotation of the adjustment mechanism in both directions of rotation, the zero-stop mechanism comprising a first stop member fixed to said fixed base portion, a second stop member removeably affixed to the adjustment member, and a movement limit member extending around the adjustment mechanism and comprising a substantially annular main body and a lug extending away from said main body, the lug comprising first and second sides facing, respectively, in opposite rotational directions;

wherein the method comprises:

removing the turret knob from the turret assembly;

releasing the second stop member from the adjustment mechanism so that the second stop member is freed from being carried by rotational movement of the adjustment mechanism;

making a desired sighting adjustment of a telescopic scope;

adjusting the rotational position of the second stop member with respect to the adjustment mechanism in either the first direction of rotation or the second direction of rotation until the first side of the lug comes into contact with one of the first and second stop members and the second side of the lug comes into contact with the other one of the first and second stop members;

securing the second stop member to the adjustment mechanism so that the second stop member will rotate in unison with the adjustment mechanism about the axis of the turret and thereby setting in one of said rotational direction a first rotation limit corresponding to the desired sighting adjustment, a second rotation limit in the other rotational direction being set by contact between the lug and both the first and second stop members after more than one full turn of the adjustment mechanism and less than two full turns of the adjustment mechanism; and affixing the turret knob to the turret assembly.

The desired sighting adjustment may be made either with the turret knob attached, or with the turret knob removed. After the desired sighting adjustment has been made, the turret knob may, if this has been attached during the sighting adjustment, be removed, if needed, to gain access to the adjustment mechanism.

Preferably, the first side of the lug faces in the first rotational direction and the second side of the lug faces in the second rotational direction.

Preferably the turret knob comprises a cap portion and a substantially cylindrical skirt portion that depends axially from the cap portion. In a preferred embodiment of the invention, the zero-stop mechanism is concealed behind the skirt portion when the turret knob is affixed to the adjustment mechanism.

The substantially annular main body of the movement limit member may have radially outer and radially inner surfaces that are substantially cylindrical. These cylindrical inner and outer surfaces may then be bounded by opposite end surfaces of the main body that are substantially annular in shape and that extend in planes that are perpendicular to the turret axis.

The rotation of the adjustment mechanism is preferably quantized by a click-stop mechanism so that the rotation of the turret knob is held at desired points around a revolution of the turret knob.

In a preferred embodiment of the invention, the turret knob is removeably attached to the adjustment mechanism. When attached, this may protectively conceal all or most of the adjustment mechanism. When removed, this provides access to the zero-stop mechanism for a user to rotationally disengage the second stop member from the adjustment mechanism so that a zero-stop rotational position of the adjustment mechanism can be set, after sighting in of the turret.

The zero-stop mechanism may comprise a substantially annular mount that extends circumferentially around the adjustment mechanism, from which the second stop member extends. The annular mount may be configured to be releasably securable to the adjustment mechanism.

The second stop member may be mounted to a supporting portion of the annular mount.

The annular mount of the zero-stop mechanism is preferably ring-shaped but need not be an unbroken ring extending around a full circle. It is sufficient only that the zero-stop mechanism extends around more than half a circle so that it is rotationally seated around the adjustment mechanism.

The annular mount preferably comprises a collar that extends fully around the adjustment mechanism.

In a preferred embodiment, the second stop member is a pin that extends substantially parallel with the axis of the turret.

Most preferably, the pin extends in a direction from a main body portion of the collar towards the base portion of the turret assembly.

The collar may have a shield that extends from the main body portion of the collar. The pin can then be shielded in a radial direction by the shield.

The annular mount may comprise a ring that extends fully around the adjustment mechanism.

The annular mount may comprise a skirt that extends from an outer periphery of said ring in a direction towards the base portion of the turret assembly. Preferably, the skirt that extends coaxially with the ring of the annular mount. The skirt then may provide a shield for the pin.

The annular mount preferably comprises at least one fixing member for releasably securing the annular mount to a radially outwards surface of the adjustment mechanism. The fixing member may, for example, be a grub screw that extends radially inwards from an aperture in a circumferentially extending surface of the annular mount to bear on this radially outwards surface.

The turret knob is preferably removeably secured to the adjustment mechanism and the adjustment mechanism may be provided with a series of grip features extending around a rim of the adjustment mechanism by which a user may, in use, grip this rim to rotate the adjustment mechanism to make a sighting adjustment when the turret knob is removed from the adjustment mechanism.

The configuration of the lug, the first stop member and the second stop member is such that the movement limit member is interposed rotationally between the first and second stop members.

The substantially annular main body of the movement limit member is most preferably ring-shaped.

The main body of the movement limit member is preferably ring-shaped but need not be an unbroken ring extending around a full circle. It is sufficient only that the movement limit member extends around more than half a circle so that it is rotationally seated as part of the turret assembly.

The substantially annular main body of the movement limit member may be seated on an annular ledge extending around the adjustment mechanism. The fixed base portion may be in the shape of an upwardly facing cup in which the adjustment mechanism is rotationally seated, this cup having a rim that is radially outwards from this annular ledge.

The rim of the cup may be axially offset with respect to the ledge around the adjustment mechanism to provide a clearance gap with the substantially annular main body of the movement limit member.

The first stop member may be mounted to a supporting portion of the rim of the cup.

The first stop member is most preferably a pin that extends substantially parallel with the axis of the turret. For example, the turret knob may comprise a cap portion and the pin may extend in a direction from the fixed base portion towards the cap portion of the turret knob.

In a preferred embodiment of the invention, the first stop member is radially outwards with respect to the second stop member. The first stop member may have a first extent in a direction parallel with the axis of the turret and the second stop member may have a second extent in a direction parallel with the axis of the turret. These first and second extents preferably overlapping one another in a plane perpendicular to the axis of the turret assembly. This helps to limit, in an axial direction, the extent of the lug, in order to help keep the turret assembly relatively compact.

The lug may extend both axially and radially away from the main body of the movement limit member. The axial projection may be configured to contact the second stop member and the radial projection may be configured to contact the first stop member.

The first and second sides of the lug preferably present respective first and second abutment surfaces that are oriented, substantially, in opposite rotational directions of the movement limit member. For example, the first and second abutment surfaces may be parallel with each other or, alternatively, lie in a plane extending through the axis of the turret.

The first and second stop members preferably present respective first and second stop surfaces that are oriented, substantially, in opposite rotational directions of the movement limit member.

The first side of the lug may present a first common face for contacting, at a first limit of rotation, the first stop member and for contacting, at a second limit of rotation opposite to the first limit of rotation, the second stop member.

Additionally, or alternatively, the second side of the lug may present a second common face for contacting, at a first limit of rotation, the second stop member and for contacting, at a second limit of rotation opposite to the first limit of rotation, the first stop member.

The turret knob may comprise a cap and a skirt that depends axially from a periphery of the cap. The adjustment mechanism may then comprise an axially slideable member that is movable between a raised orientation and a lowered orientation, the cap being removeably mounted to the axially slideable member.

The skirt and the fixed base portion preferably have therebetween matching formations which, in use, interengage to lock the turret knob against rotation when the turret knob is depressed to cause the axially slideable member to be in the lowered orientation, and which disengage to free rotationally the turret knob when the turret knob is pulled up to cause the axially slideable member to be in the raised orientation.

Additionally, or alternatively, the axially slideable member when in the lowered orientation may be configured to overlap the substantially annular mount, thereby limiting axial movement of the annular mount away from the fixed base portion when the annular mount is rotationally released from the adjustment mechanism.

BRIEF DESCRIPTION OF THE DRAWINGS

Preferred embodiments will now be further described, by way of example only, and with reference to the accompanying drawings, in which.

DETAILED DESCRIPTION

Figure 1:
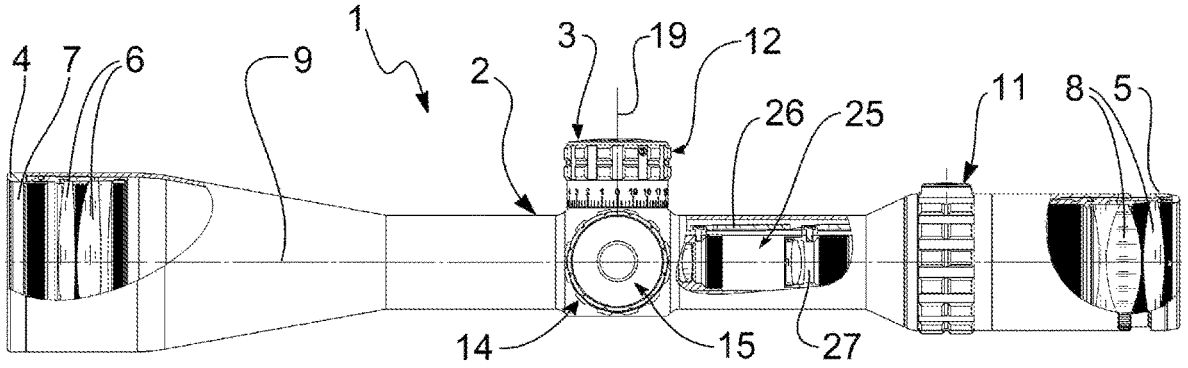
FIG. 1 is a side view of a telescopic sight, having a pair of sighting adjustment turrets one for adjusting elevation and the other for adjusting windage, including an elevation turret according to a preferred embodiment of the invention.

FIG. 1 shows a side view of a telescopic sight 1 for a firearm. When mounted on a firearm, the telescopic sight, also called a scope, presents to a user of the sight an aiming point in a telescopically magnified image.

The telescopic sight has an elongate external housing 2, of generally cylindrical shape, which will normally be composed of several metallic or plastic components joined together to from a sealed enclosure for optical components held within the housing between opposite objective and eyepiece ends 4, 5 of the housing.

The optical components include a multi-component objective lens system 6 protected by a plain front cover glass 7, a multi-component eyepiece lens system 8, and between these lenses inside a central portion of the housing, an adjustable sighting assembly 25. The opposite lens systems 6, 8 define an optical axis 9 of the housing.

Mounted externally on the central portion of the housing 2 is a pair of sighting mechanisms in the form of turrets, one of which 12 is an elevation turret with a rotatable turret adjustment knob 3 which can be manually turned to adjusting the elevation of an aiming point and the other of which 14 is a windage turret with a rotatable turret adjustment knob 15 which can be manually turned to adjust the lateral position of an aiming point. As will be explained in more detail below, the elevation turret has an adjustable zero-stop mechanism for setting a movement limit corresponding to a relatively short distance at which the sight can be sighted in against a target. In use at longer distances, the turret can then be adjusted to raise the aiming point to compensate for the drop of the bullet. Apart from this zero-stop mechanism, the sighting mechanisms 12, 14 are the same, and so the windage turret 14 will not be further described in detail.

Concentric with the housing, and next to the eyepiece end 5, is a zoom adjustment ring 11. The particular form of the zoom adjustment ring and associated zoom optics is not central to the invention and may, for example, be as described in patent document WO 2018/096475 A1, the contents of which are hereby incorporated by reference.

Figure 2:
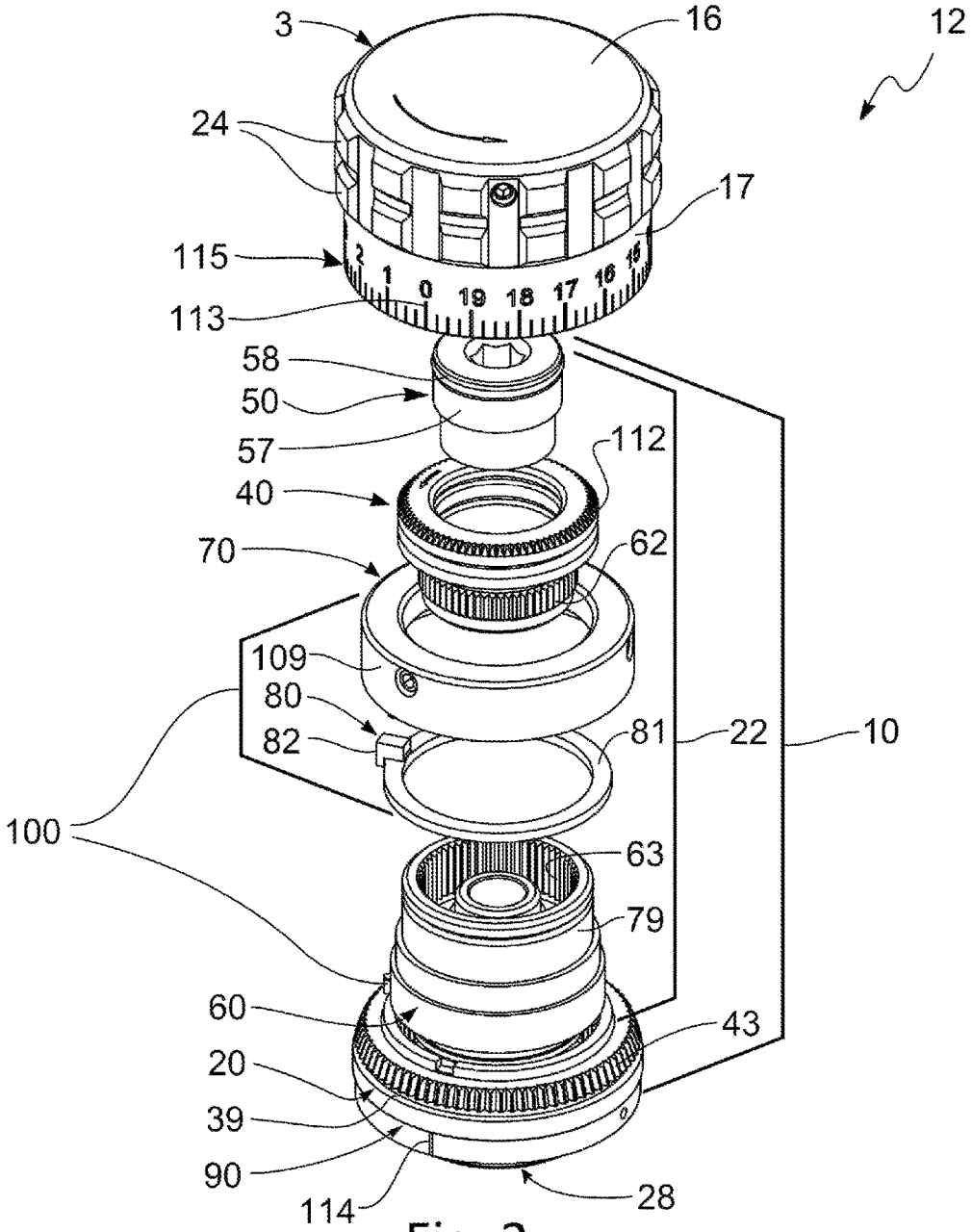
FIGS. 2 to 4 are exploded views of the elevation turret of FIG. 1, showing how the turret has a turret knob inside of which is a turret assembly that comprises a fixed base portion, a plunger inside the base portion, and a rotatable adjustment mechanism linked to the plunger.
Figure 3:
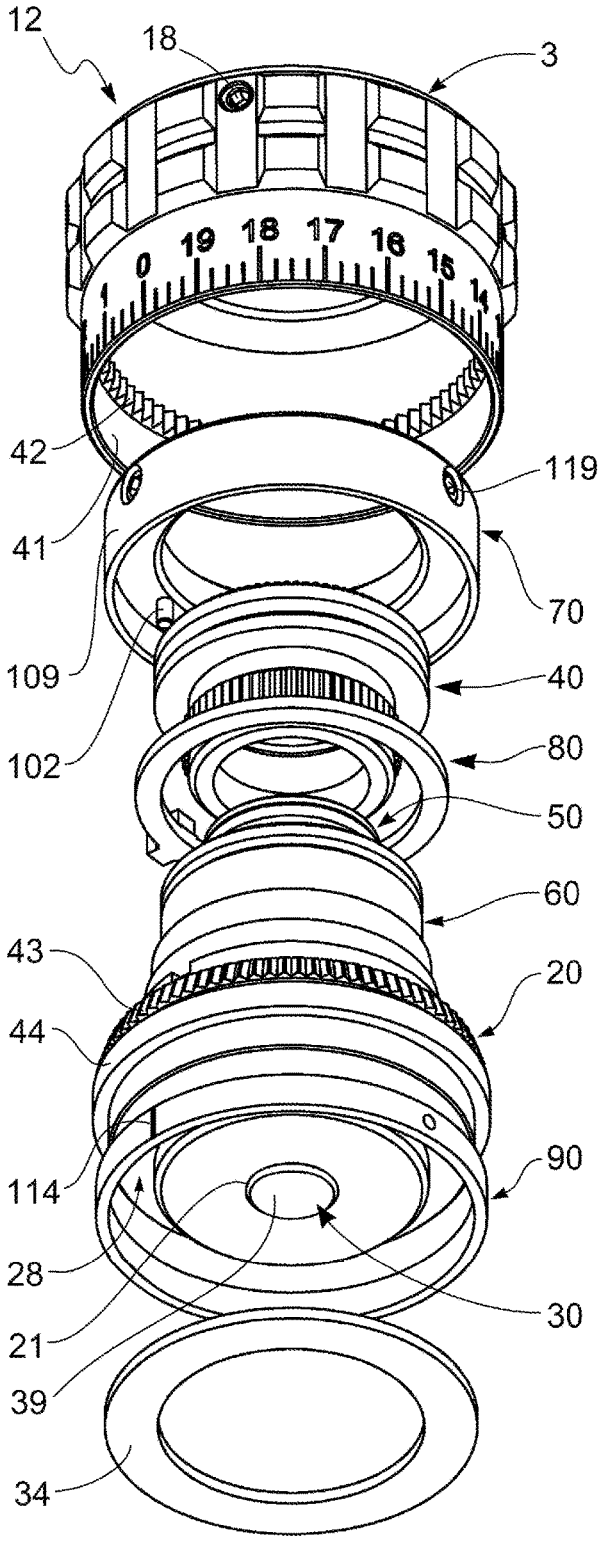
Figure 4:
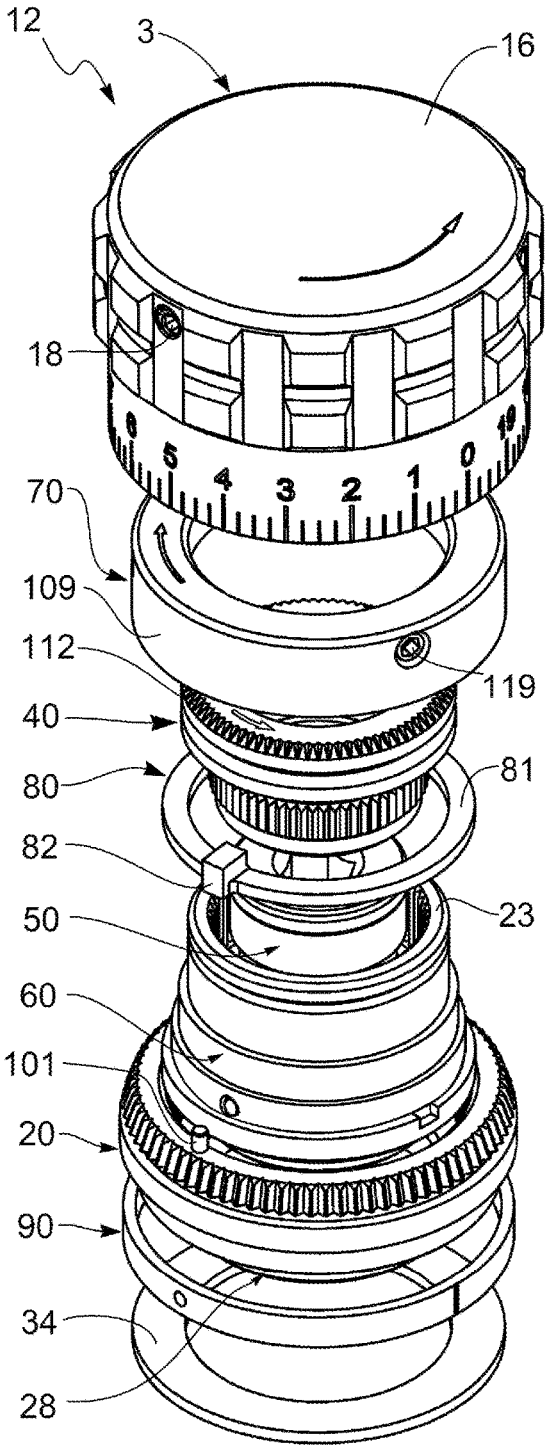

FIGS. 2 to 4 are exploded views of the elevation turret 12, showing how the turret knob 3 has the shape of an inverted cup, with a disc-like end cap 16 from which depends a tubular skirt 17 towards the housing axis 9. The turret knob 3 surrounds an inner turret assembly 10. The tubular skirt is substantially cylindrical. Knurled surface features 24 are provided on the turret adjustment knob across a radially outer surface of the skirt and an adjacent radially outer surface of the end cap in order to facilitate gripping and manual turning by a user of the turret knob.

As shown in the cross-sections of FIGS. 9 to 13, the turret assembly 10 comprises a base portion 20 fixed to the scope housing 2, an axially movable plunger 30 that extends from inside the fixed base portion out through an aperture 21 in the fixed base portion, and an adjustment mechanism 22 linked to the plunger. The adjustment mechanism 22 is rotationally seated inside a substantially cylindrical upwardly facing cup 23 provided by the fixed base portion 20.

In use, the turret knob 3 is removeably affixed to the adjustment mechanism 22, for example by means of grub screws 18. The adjustment mechanism 22 is rotateably mounted to the fixed base portion 20 and is configured, in use, to drive axial movement of the plunger 30 along an axis 19 of the turret assembly that extends at right angles to the housing optical axis 9. The adjustment mechanism therefore converts rotational movement of the turret knob 3 in one or the other rotational directions into movement of the plunger 30 along the axis 19 of the turret assembly either towards or away from the housing axis 9 for actuating a movable member within the housing. For example, an end surface 39 of the plunger may bear upon an image erector tube 26 to cause a corresponding shift in in an aiming point provided by a reticle 27 of the adjustable sighting assembly 25, as explained in more detail in WO 2018/096475 A1. The end surface 39 is therefore an actuation surface of the plunger.

The fixed base portion 20 has a seat 28 for fixing the turret assembly 10 to a circular aperture 29 in the housing 2 of the telescopic sight 1, for example as shown in the drawings by means of matching screw threads 31 on a stem 32 of the fixed base portion and on a circular inner surface 33 of the aperture 29 in the housing. A compressible washer 34 between an annular flange 35 of the fixed base portion and a corresponding annular flat surface 36 around the aperture 29 makes an air-tight seal around an outer periphery of the seat 28.

The turret adjustment knob 3 is generally symmetrical about the turret axis 19. Together, the turret end cap 16 and skirt 17, which are formed as a one-piece component, provide the turret adjustment knob 3 in the form of a rotatable, inverted cup, which extends around the parts of the inner turret assembly 10 that extend away from the scope housing 2.

The turret end cap 16 is removeably secured to an upper portion 10' of the turret assembly 10. As shown respectively in FIGS. 10 and 13, the inner turret assembly comprises an axially slideable member, which in this example is a sleeve 40 that is axially slideable between lowered and raised positions with respect to the fixed base portion 20 of the turret assembly.

Figure 5:
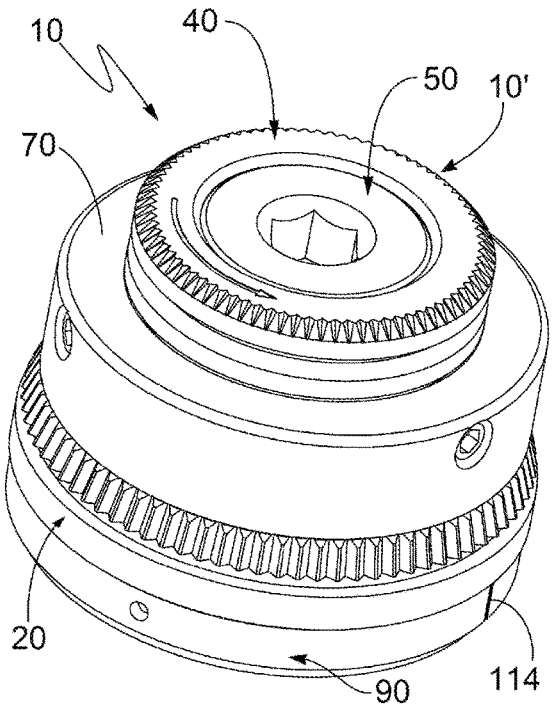
FIG. 5 shows the turret assembly in an assembled state, without the turret knob, to which is secured by means of three grub screws a substantially annular mount which forms part of a zero-stop mechanism.

FIG. 5 shows a view of the inner turret assembly 10 with the turret end cap 16 removed and the sleeve 40 in the lowered position.

The sleeve 40 is part of the adjustment mechanism 22 and is linked to the plunger by a lock cap 50 on which the sleeve is axially slidably mounted. The skirt 17 has on a substantially cylindrical inner surface 41 a raised series of teeth 42 which provide alternating ridges and grooves that extend in a frusto-conical band around the skirt 17. The series of teeth 42 on the skirt face downward and radially inwards towards a matching series of teeth 43 on a radially outer surface 44 of the cup 23 of the fixed base portion 20 of the turret assembly and which provide a series of alternating ridges and grooves that extend in a frusto-conical band around the fixed base portion. The series of teeth 43 on the fixed base portion 20 therefore face upwards and radially outwards towards the series of teeth 42 on the skirt 17, which therefore face downwards and radially inwards. The arrangement is such that when the sleeve 40 is in the lowered position, the two series of teeth 42, 43, which preferably have a V-shaped profile, intermesh, to provide a spline between the turret knob 3 and the fixed base portion 20, thereby rotationally locking the turret knob to the fixed base portion. This allows a user to fix a desired elevation. When the sleeve 40 is in the raised position, the two series of teeth 42, 43 disengage, thereby rotationally freeing the turret knob 3 from the fixed base portion 20 of the turret assembly 10. This allows a user to vary the elevation.

In addition to the sleeve 40, the adjustment mechanism 22 comprises, towards a lower end, a rotatable base part or portion 60 which is rotateably seated in the upwardly facing cup 23 provided by the fixed base portion 20 of the turret assembly 10. The rotatable base portion 60 of the adjustment mechanism comprises a main body 68 which has a radially outer surface 61 with a stepped cylindrical form.

The adjustment mechanism 22 comprises towards an upper end the lock cap 50, which has a downwardly facing threaded socket 46 into which is screwed a threaded post 47 that extends upwardly from the main body 68 of the rotatable base portion 60. The lock cap 50 is therefore secured to the rotational main body 68 by matching threads 48 between the downwardly facing socket 46 and upwardly extending post 47 in order to rotationally bind the lock cap 50 to the rotatable base portion 60 of the adjustment mechanism.

The lock cap 50 is removeably fixed to the rotatable base 60 of the adjustment mechanism. The skilled person will appreciate that this can be done in various ways, for example with a through bolt (not shown), but in this preferred embodiment an upper face 51 of the lock cap has a socket 52, which in this example is a hex socket, for receiving a tool, for example a hex wrench (not shown), so that the lock cap 50 can be tightly screwed to the rotatable base portion 60 of the adjustment mechanism 22.

Figure 13:
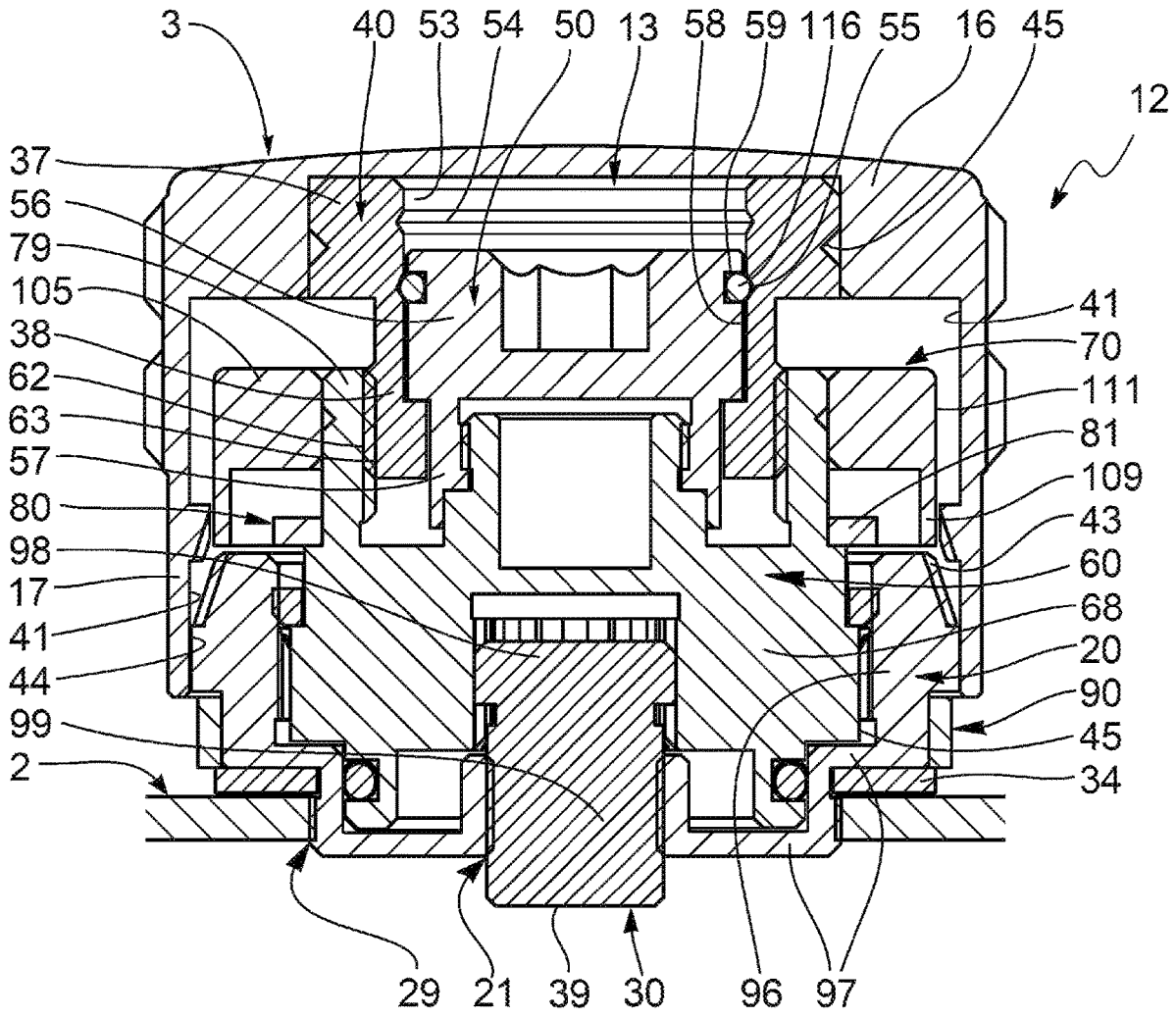
FIG. 13 is a section of the turret of FIG. 9 along a plane at right angles to the view of FIG. 11 and with the turret knob in a raised position so as to be rotationally disengaged from the fixed base portion.

As shown most clearly in FIG. 13, an upper portion or part 37 of the sleeve 40 proximate the end cap 16 of the turret knob 3 is in the form of a ring. This ring 37 has a substantially cylindrical inner surface 53 in which there is a first circumferential groove 54 and a second circumferential groove 55. These circumferential grooves 54, 55 are axially spaced apart and are preferably V-shaped in profile, with the first circumferential groove 54 being closer to the end cap 16 of the turret knob 3 than the second circumferential groove 55.

The upper part or ring 37 of the sleeve 40 is relatively thicker in the radial direction than a lower portion or part 38 of the sleeve, which is in the form of a tube-like downward extension from the upper ring 37.

The turret end cap 16 has a cylindrical recess 13 that is that is concentric with the turret axis 19. The ring-like upper part 37 of the sleeve is removeably received within cylindrical recess 13. In this example, the turret end cap 16 is secured to the sleeve by means of the three grub screws 18 each of which extends radially inwards from the knurled outer surface features 24 of the turret adjustment knob 3 along a threaded bore 49 through the end cap to engage with a groove 45, which is preferably V-shaped in profile, that extends circumferentially around the upper part 37 of the sleeve.

A lowermost portion of the tube-like part 38 of the sleeve 40, which is relatively furthest from the end cap 16, has a reduced inner diameter relative to the ring-like upper part 37 of the sleeve on which the first and second circumferential grooves 54, 55 are provided.

The lock cap 50 has an upper portion 56 proximate the end cap 16 and a lower portion 57 that is relatively further from the end cap than the upper portion 56. The upper portion 56 provides a main body for the lock cap 50 and the lower portion 57 is in the form of a tubular extension from the main body inside of which is the downwardly facing socket 46. The lower portion 57 of the lock cap 50 is of reduced outer diameter relative to the upper portion 56 of the lock cap The upper portion 56 of the lock cap 50 has a substantially cylindrical outer surface 58 around which a groove 59 extends circumferentially, preferably square-shaped in profile, and in which is partially seated an O-ring 116. This O-ring 116 is resiliently compressible and expands to seat in either the first or second circumferential grooves 54, 55 when the sleeve 40 is slid, respectively, towards or away from the rotatable base portion 60 of the adjustment mechanism 22.

Figure 10:
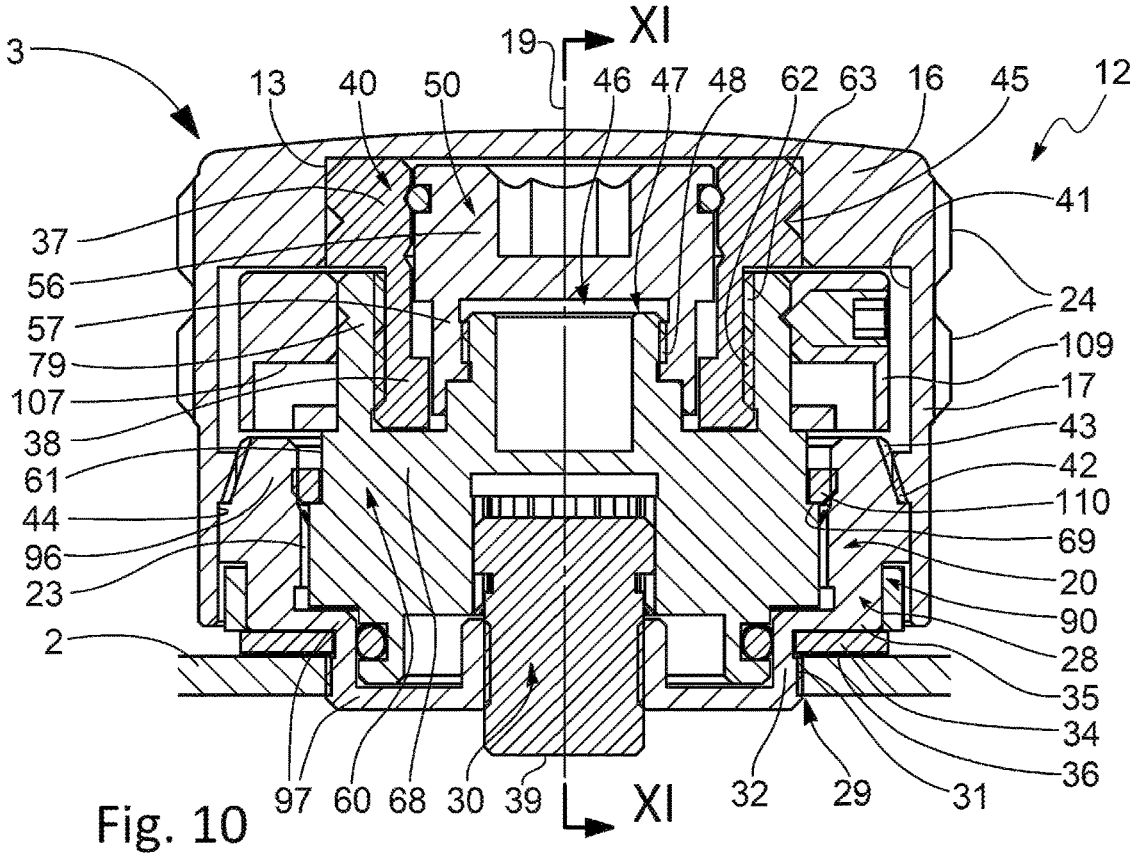
FIG. 10 is a section of the turret of FIG. 9 along line X-X of FIG. 9.
Figure 11:
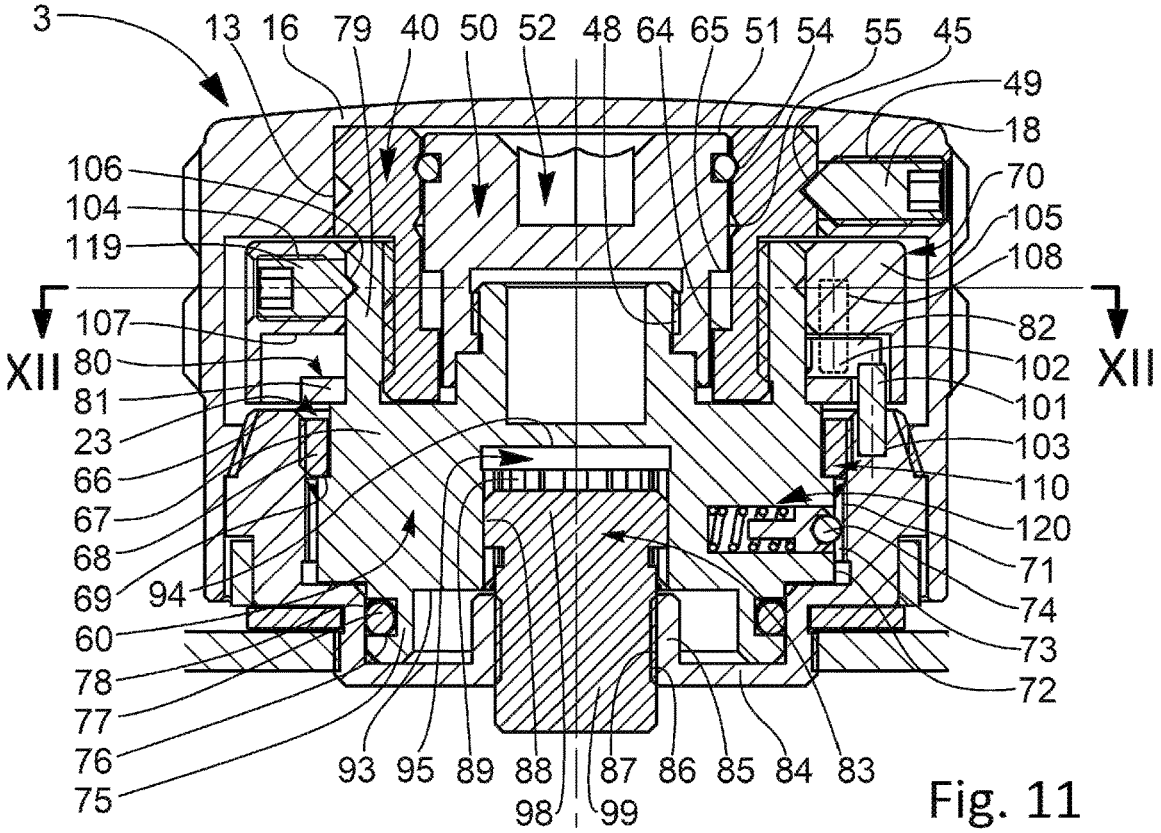
FIG. 11 is a section of the turret of FIG. 9 along line XI-XI of FIG. 10.
Figure 12:
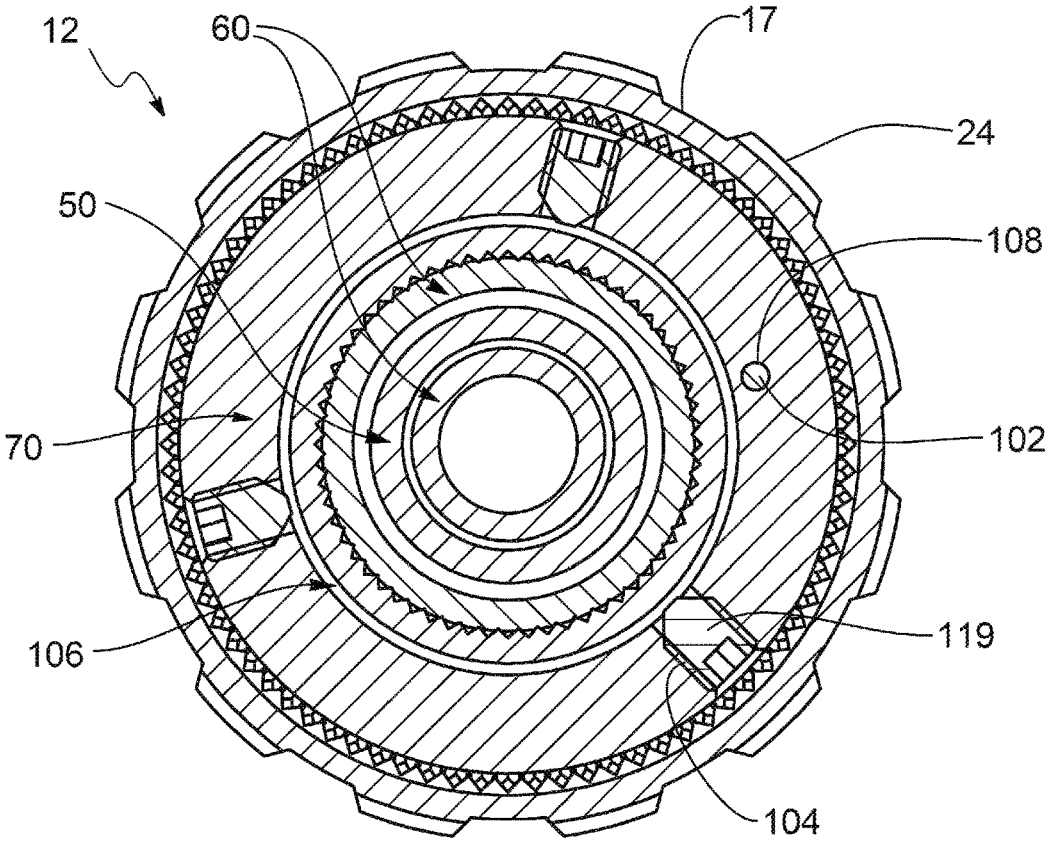
FIG. 12 is a section of the turret of FIG. 9 along line XII-XII of FIG. 11.

The lower portion 38 of the sleeve 40 is of reduced outer diameter relative to the upper portion 37 of the sleeve. Around the full circumference of this lower portion 38 is provided a series of axially extending teeth 62 that face outwardly to intermesh with a matching series of teeth 63 that face inwardly from a tubular portion 79 that extends upwardly from the main body 68 of the rotatable base portion 60 of the adjustment mechanism. These teeth 62, 63 intermesh to provide a spline between the sleeve 40 and the rotatable base portion 60, thereby rotationally locking the sleeve to the rotatable base portion, while permitting relative axial movement between the sleeve and the rest of the adjustment mechanism 22. These two series of teeth 62, 63 of the sleeve 40 and the rotatable base 60 therefore remain intermeshed as the sleeve slides between the lowered and raised orientations as shown in FIGS. 10 and 13.

The inner profile of the sleeve 40 has an upwardly facing annular step 64 between its upper and lower portions 37, 38. Because the sleeve lower portion 38 is of reduced inner diameter with respect to the sleeve upper portion 37, this annular step 64 faces in an axial direction towards the end cap 16.

Similarly, the outer profile of the lock cap 50 has an annular step 65 between its upper and lower portions 56, 57. Because the lock cap lower portion 57 is of reduced inner diameter with respect to the lock cap upper portion 56, this annular step 65 faces in an axial direction away from the end cap 16. The arrangement is such that the two annular steps 64, 65 between the sleeve 40 and the lock cap 50 face towards one another.

The two annular steps 64, 65 between the sleeve 40 and the lock cap 50 come into contact with each other to limit upwards movement of the sleeve 40 relative to the lock cap 50, and this preferably coincides with the seating of the O-ring 116 in the second circumferential groove 55.

The sleeve 40 and the lock cap 50 are assembled to the rotatable base portion 60 of the adjustment mechanism 22 by first assembling the sleeve 40 over the lock cap 50, and then screwing the downwardly facing socket 46 of the lock cap over the upwardly extending threaded post 47 that extends upwardly from the main body 68 of the rotatable base portion 60.

When the sleeve 40 is in the raised orientation, such that the turret knob 3 is disengaged with the fixed base portion 20 of the turret assembly 10, the knob may be turned in either clockwise or anticlockwise directions. This causes the rotatable base portion 60 of the adjustment mechanism 22 to rotate with respect to the seat 28 of the fixed base portion 20.

The seat 28 has a lower portion 97 proximate the housing 2 and which provides the stem 32 with which the seat is secured to the housing. An upper portion 96 of the seat 28 is of greater is diameter than the lower portion 97, and provides the upwardly facing cup 23 inside of which the base part or portion 60 of the adjustment mechanism 22 rotates.

The upwardly facing cup 23 has an annular rim 66. The outwardly and upwardly angled band of teeth 43 are radially outward of the rim 66. Radially inwardly of the rim, the cup 23 is generally cylindrical in form with a threaded portion 67 proximate the rim 66. During assembly, the main body 68 of the rotatable base portion 60 is inserted into the upwardly facing cup 23, and then an outwardly threaded lock ring 110 is screwed inside the threaded portion 67 proximate the rim until a close clearance fit is achieved between the lock ring 110 and an annular ledge 69 that extends circumferentially around the main body 68 of the rotatable base portion 60. The fit is such that the rotatable base portion is still free to rotate within the cup 23 but is constrained from moving axially out from the cup by the lock ring.

Further from the rim, around the full inner circumference of the cup, is a series of axially extending click-stop teeth 71, separated from an outer cylindrical surface 72 of the main body 68 of the rotatable base portion 60 by a clearance gap 73. The main body 68 of the rotatable base portion houses part of a click-stop mechanism 120 that biases a ball bearing 74 across the clearance gap 73 and into engagement with intervals between the teeth 71 in order to quantize rotation of the adjustment mechanism 22.

A tubular lowermost extension 75 of the main body 68 of the rotatable base 60 has a radially outwardly facing annular groove 76 in which is seated a resiliently compressible O-ring 77 that expands to press against a cylindrical inner surface 78 of the lower portion 97 of the seat. This helps to provide an air-tight seal around the aperture 21 of the fixed base portion 20 and also a smooth sliding bearing between the rotatable base portion 60 and the fixed base portion 20.

The aperture 21 of the fixed base portion 20 is centered on the axis 19 of the turret assembly 10 and is provided in an annular base 84 of the lower portion 97 of the seat, and leads to an upwardly extending tube 85 with an inner thread 86. A lower portion 99 of the plunger 30 is substantially cylindrical and extends through this tube 85 to project away from the fixed base portion 20 towards the scope housing axis 9. The lower portion 99 of the plunger has an external thread 87 that matches the internal thread 86 of the upwardly extending tube 85.

An upper portion 98 of the plunger 30 has a mushroom head 83 around a periphery of which is provided a series of axially extending teeth 88 that face radially outwardly to intermesh with a matching series of teeth 89 that face radially inwardly from a substantially cylindrical recess 95 that extends axially upwards from a lower annular surface 93 of the main body 68 of the rotatable base portion 60. These teeth 88, 89 intermesh to provide a spline between the plunger 30 and the main body 68 of the rotatable base portion 60, thereby rotationally locking the plunger 30 to the main body 68 of the rotatable base portion 60 while permitting relative axial movement between the plunger and the main body. These two series of teeth 88, 89 of the plunger 30 and the main body 68 therefore remain intermeshed as the plunger is driven axially in one direction or the other by the rotation of the main body 68 of the rotatable base portion 60 of the adjustment mechanism 22.

In the absence of any other mechanism to limit the extent of rotation of the adjustment mechanism, the extent of rotation is preferably limited in one rotational direction, by interaction of the plunger 30 with the main body 68 of the rotatable base portion and, in the other rotational direction, by interaction of the plunger 30 with the seat 28.

In this example, in one direction of rotation, as the plunger is driven towards the scope housing axis 9, the movement of the plunger 30, and hence rotational movement of the adjustment mechanism 22, is limited when the mushroom head 83 comes into contact with the upwardly extending tube 85.

The adjustment mechanism therefore converts the rotational movement of the turret knob to movement of the plunger to cause a corresponding shift in the transverse orientation of a sighting element and/or other associated internal optical components within the scope.

Also in this example, in the other direction of rotation, as the plunger is driven away from the scope housing axis 9, the movement of the plunger 30, and hence rotational movement of the adjustment mechanism 22, is limited when the mushroom head 83 comes into contact with an end surface 94 of the recess 95 within which the plunger is slidably seated.

The turret assembly 10 further comprises a zero-stop mechanism 100 for limiting the rotation of the adjustment mechanism 10 in both directions of rotation, i.e. clockwise or anticlockwise rotational directions. The zero-stop mechanism 100 comprises a first stop member 101 for limiting rotation of the adjustment mechanism in a first direction. The first stop member is fixed to the fixed base portion 20. In this example, the first stop member is a fixed pin 101 that extends in an axial direction (i.e. parallel to the turret assembly axis 19) at a first radial distance away from the turret assembly axis. As shown most clearly in FIG. 11, the fixed pin 101 extends upwards from the rim 66 of the fixed base portion 20. The fixed pin 101 extends downwards into a cylindrical recess 103 in the rim by which means the fixed pin is fixed to the fixed base portion 20 at a particular circumferential location on the fixed base portion.

The zero-stop mechanism 100 also comprises a second stop member 102 for limiting rotation of the adjustment mechanism, and which is releasably secured to the rotatable adjustment mechanism 22. In this example, the second stop member is a movable pin 102 that extends in a direction parallel to the turret assembly axis 19 at a second radial distance away from the turret assembly axis 19. The movable pin, either when secured to or released from the rotatable adjustment mechanism 22, is configured to be rotatable about the turret assembly axis 19.

In this example, the second radial distance is less than the first radial distance, however, in other embodiments (not illustrated) the two radial distances could be the same or the second radial distance could be more than the first radial distance. The illustrated embodiment is, however, preferred because this lends itself to a more compact arrangement of components in both axial and radial directions.

As shown in FIGS. 2, 6 to 8 and 11, the zero-stop mechanism 100 also comprises a movement limit member 80 that is interposed rotationally between the first and second stop members 101, 102.

The moveable pin 102 is securable to the rotatable adjustment mechanism 22 by means of a substantially annular mount 70 which therefore forms part of the zero-stop mechanism 100. In this example, the annular mount is a collar 70. The collar 70 is substantially ring-shaped. The annular mount is removeably secured to the adjustment mechanism 22 by a manually operable fixing 119. In this example, the manually operable fixing is a set of three grub screws 119 that extend through threaded bores 104 in a ring-like main body 105 of the collar, to engage with a groove 106 that extends circumferentially around the upwardly extending cylindrical wall 79 of the rotatable base portion 60. The main body 105 of the collar has an annular lower surface 107, from an outer periphery of which the moveable second stop member extends downwards. In this example, the moveable second stop member is a second pin 102. The second pin is seated inside a recess 108 within the main body of the collar 70.

The collar 70 also comprises a skirt 109 which depends axially from a periphery 111 of the collar in a direction towards the fixed base portion 20. The arrangement is such that the skirt provides a shield for the second pin 102, as well as shielding the movement limit member 80 and first pin 101.

The second stop member 102, when secured to the adjustment mechanism 22, is rotationally carried by rotational movement of the adjustment mechanism and when released from the adjustment mechanism is freed from being carried by this rotational movement.

Figure 6:
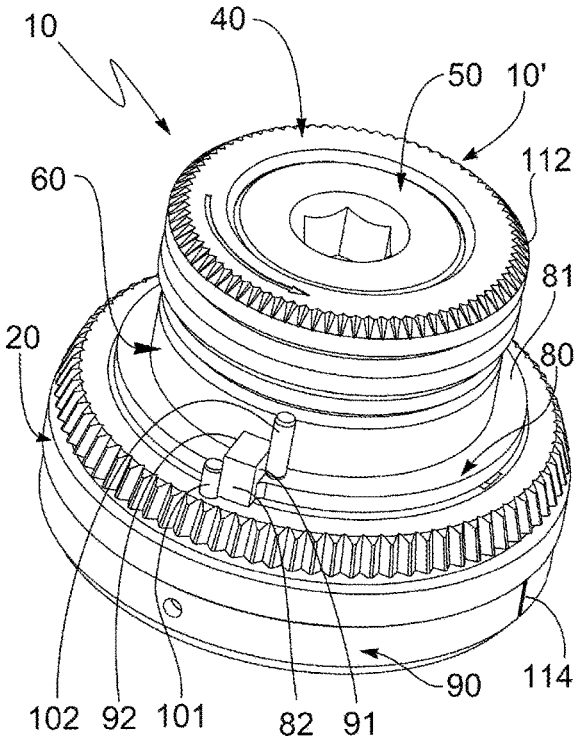
FIG. 6 shows the turret assembly with the annular mount omitted only for purposes of illustration in order to show the position of a movable stop member in the form of a movable pin that is mounted to the annular mount, and also to show a movement limitation ring with a projecting lug and a fixed stop member in the form of a fixed pin which is secured to a rim of the fixed base portion.
Figure 8:
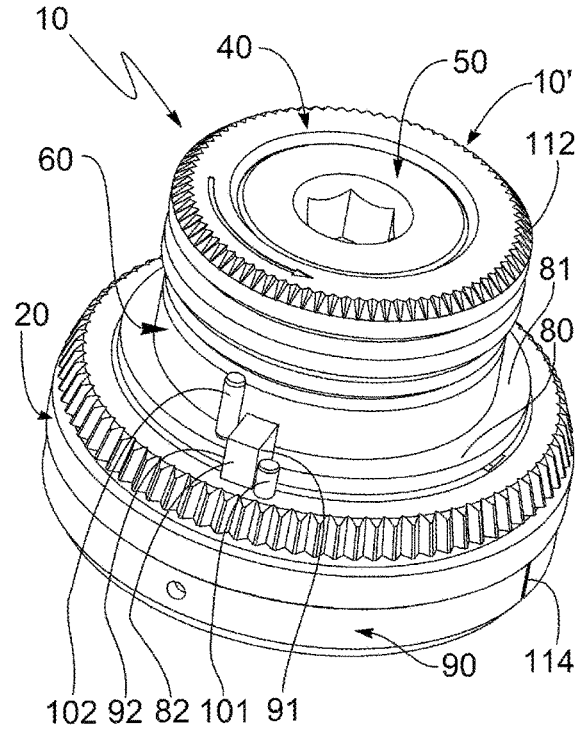
Figure 9:
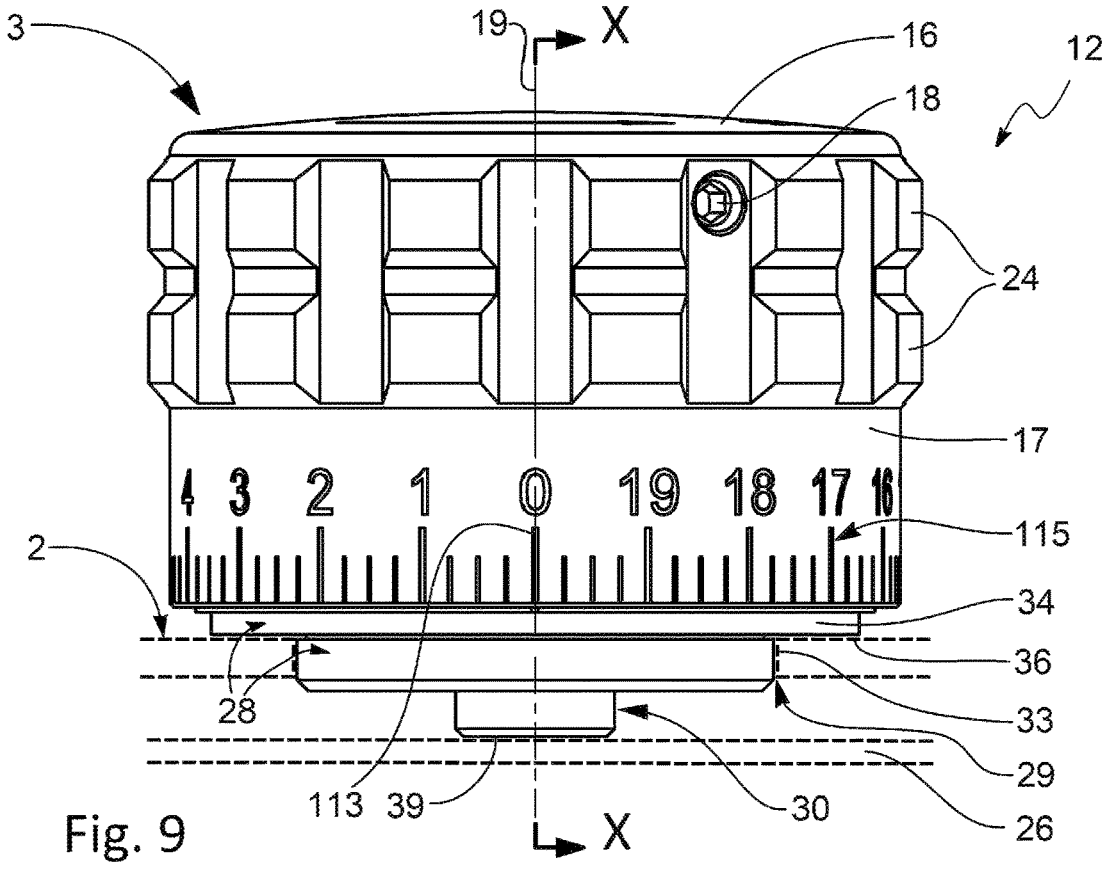
FIG. 9 is a side plan view of the elevation turret of FIG. 1.

The movement limit member 80 extends around the turret assembly 10. In FIGS. 6 and 8, the annular mount 70 is omitted so that the operation of the internal components of the zero-stop mechanism 100 can be seen.

The movement limit member 80 comprises a substantially annular main body 81 and a projection, or lug 82. The main body 81 is rotatable about the axis 19 of the turret with respect to both the fixed base portion 20 and the adjustment mechanism 22. The lug 82 is an axial and radial projection that extends away from the main body 81 of the movement limit member. The lug is therefore guided by the rotation this main body to move along a circular path.

In this example, the substantially annular main body of the movement limit member is ring-shaped but the substantially annular main body need not be an unbroken ring extending fully around the turret assembly. It is sufficient only that the movement limit member extends around turret assembly by more than half a circle so that it is rotationally seated as part of the turret assembly.

Figure 7:
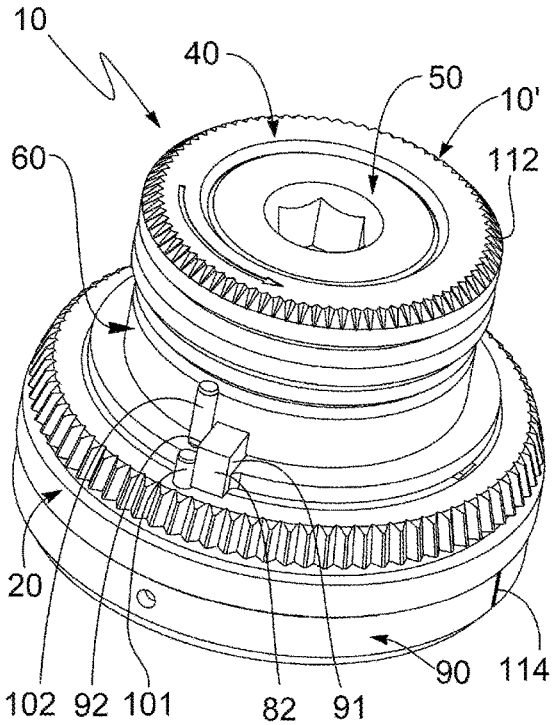
FIGS. 7 and 8 illustrate how the movable pin and movement limitation ring move from one rotational stop limit as shown in FIG. 6 to an opposite rotational stop limit as shown in FIG. 8.

As shown in FIGS. 6 to 7, the projecting lug 82 has a first side 91 and opposite the first side a second side 92. These sides preferably extend in a pair of corresponding planes parallel with the axis 19 of turret, which term includes planes that pass through the axis of turret and planes that are offset from and parallel with the axis of the turret. The first and second sides 91, 92 therefore face in substantially opposite circumferential directions.

The shape of the lug need not be identical to that as illustrated, as long as the opposite first and second sides 91, 92 of the lug are guided by rotation of the main body 81 along a circular path as the main body 81 is rotated. In each direction of rotation, one of the sides of the lug will therefore face substantially in the direction of rotation.

The configuration of the lug 82, the first stop member 101 and the second stop 102 member, when rotationally secured to the adjustment mechanism 22 is such that in the first direction of rotation of the adjustment mechanism, for example clockwise looking down on the turret assembly 10, the second stop member 102 comes into contact with the first side 91 of the lug 82. This causes the main body 81 of the movement limit member 80 to be rotated in the clockwise direction of rotation by the lug 82 as the lug is moved along the circular path by the second stop member 102 until a second side 92 of the lug comes into contact with the first stop member 101, thereby limiting the rotation in the clockwise direction, as illustrated in FIG. 6.

In a second direction of rotation of the adjustment mechanism, which in this example would be anti-clockwise, the second stop member 102 comes into contact with the second side 92 of the lug 82 as shown in FIG. 7. This causes the main body 81 of the movement limit member 80 to be rotated in the anti-clockwise direction of rotation by the lug 82 as the lug is moved along the circular path until the first side 91 of the lug comes into contact with the first stop member 101, thereby limiting the rotation of the adjustment mechanism in the anti-clockwise direction.

The configuration of the lug 82, the first stop member 101 and the second stop member 102, when rotationally released from the adjustment mechanism 22 is such that the adjustment mechanism is freed from these rotational limits.

In this example, when the turret knob 3 is removed from the turret assembly 10 and the manually operable fixing 119 is released, the annular mount 70 is no longer rotationally locked with respect to the turret adjustment mechanism 22. A user can then manually rotate the sleeve 40, which is provided with a grip feature 112, for example a series of teeth around its outer rim, as illustrated, while sighting in the scope until a desired turret setting, for example an elevation setting, has been achieved.

Following this, the rotational position of the second stop member 102 is adjusted until one or the other of the stop limits is reached, for example as illustrated in FIG. 6 or FIG. 8. The manually operable fixing 119 is then used to secure the second stop member 102 to the turret adjustment mechanism 22. This sets a rotational zero-stop for the turret assembly 10.

Prior to securing the annular mount 70, the annular mount is retained to the turret adjustment mechanism 22 and prevented from coming off in an axial direction by virtue of an overlap between a radially outermost part of the ring-like upper portion or part 37 of the sleeve 40 and a radially innermost part of the annular mount.

Finally, the turret knob 3 is re-attached to the adjustment mechanism 22 using the three grub screws 18. To indicate the zero setting, the user will, prior to fixing the turret knob, rotate this until a zero mark 113 on the turret knob 3 is aligned with an origin mark 114 which is provided on a zero-mark ring 90 which is fixed around the fixed base portion 20 immediately adjacent the scope housing 2. The zero-mark ring 90 is mostly concealed by the turret skirt 17 when this is in the lowered position, and fully exposed when the turret skirt when is in the raised position, so that a user can read off a scale 115 provided around the turret skirt 17.

The angular extent of both the first and second stop members 101, 102 is about 5° and the angular extent of the lug is about 10°. The full extent of rotation of the turret assembly 10 after the movement limit member 80 has been secured to the adjustment mechanism 22 is therefore about 20° less than two full rotations, or about 700°. This angle will be less if the lug or the first and second stop members are wider.

In the example described above, the zero-stop turret 12 is an elevation turret and the click-stop mechanism 120 provides a relatively fine gradation of movement for the elevation adjustment mechanism, in which each single click of adjustment will change the aiming point by 0.1 milliradian of angle (mrad), and with each full turn of the turret knob 3 resulting in up to 20 mrad of angle adjustment, as indicated on the scale 115. The invention may, of course employ a click mechanism with either finer or courser gradations of adjustment and with either a greater or lesser range of angle adjustment for each full turn of the turret knob.

The invention therefore provides a convenient turret comprising a zero-stop mechanism, a method of setting such a zero-stop mechanism and a method of setting a zero-stop of a sighting adjustment turret to limit an adjustment range of a sighting element of a telescopic sight.

Although a preferred embodiment of the invention has been described and illustrated in the context of an elevation turret, the invention is also applicable to other types of sighting adjustment turrets that may be used with a telescopic sight, for example a windage turret or a turret used to adjust image zoom. In the former case, the zero-stop could be a horizontal windage setting for calm conditions. In the latter case, it may be a maximum or minimum desired zoom setting.

It is to be recognized that various alterations, modifications, and/or additions may be introduced into the constructions and arrangements of parts described above without departing from the spirit or scope of the present invention, as defined by the appended claims.

The invention claimed is:

1. A turret for a telescopic sight, comprising a turret assembly and affixed externally to the turret assembly a turret knob, wherein:

the turret assembly comprises:

a base portion, the base portion having a seat for fixing the turret assembly to an aperture in a housing of a telescopic sight;

a plunger extending along an axis of the turret within the base portion, and being movable along said axis for actuating a movable member within said housing;

an adjustment mechanism linked to the plunger, the adjustment mechanism being rotateably mounted to the base portion and being configured, in use, to drive axial movement of the plunger along said axis; and the turret knob is removeably affixed externally to the turret assembly whereby the turret knob when affixed to the turret assembly is attached to the adjustment mechanism whereby, in use, a user can turn the turret knob to effect rotation of the adjustment mechanism in opposite first and second rotational directions, to move the plunger axially in opposite first and second axial directions by manually turning the turret knob in corresponding rotational directions;

wherein the turret assembly further comprises a zero-stop mechanism for limiting the rotation of the adjustment mechanism in both rotational directions, wherein the zero-stop mechanism comprises:

a first stop member for limiting rotation of the adjustment mechanism, the first stop member being fixed to the base portion;

a second stop member for limiting rotation of the adjustment mechanism, the second stop member being releasably secured to the adjustment mechanism whereby the second stop member when secured to the adjustment mechanism is rotationally carried by rotational movement of the adjustment mechanism and when released from the adjustment mechanism is freed from being carried by said rotational movement;

a movement limit member extending around the turret assembly, the movement limit member comprising: (i) a substantially annular main body, said main body being rotatable about said axis with respect to both the base portion and the adjustment mechanism; and (ii) a lug, extending away from said main body and being guided by said rotation of said main body along a circular path, and the lug having a first side and opposite the first side, a second side, and wherein, the configuration of the lug, the first stop member and the second stop member when rotationally secured to the adjustment mechanism is such that:

in the first rotational direction the second stop member comes into contact with the first side of the lug whereby said main body is rotated in the first rotational direction by the lug as the lug is moved along the circular path by the second stop member until the second side of the lug comes into contact with the first stop member, thereby limiting the rotation of the adjustment mechanism in the first rotational direction; and in the second rotational direction, the second stop member comes into contact with the second side of the lug whereby said main body is rotated in the second rotational direction by the lug as the lug is moved along the circular path until the first side of the lug comes into contact with the first stop member, thereby limiting the rotation of the adjustment mechanism in the second rotational direction;

and wherein, the configuration of the lug, the first stop member and the second stop member when rotationally released from the adjustment mechanism is such that the adjustment mechanism is freed from said rotational limits of the zero-stop mechanism.

2. The turret as claimed in claim 1, in which the zero-stop mechanism comprises a substantially annular mount that extends circumferentially around the adjustment mechanism, said mount being configured to be releasably securable to the adjustment mechanism, and the second stop member extending from the substantially annular mount.

3. The turret as claimed in claim 2, in which the second stop member is mounted to a supporting portion of the substantially annular mount.

4. The turret as claimed in claim 2, in which the substantially annular mount comprises a collar that extends fully around the adjustment mechanism.

5. The turret as claimed in claim 4, in which second stop member is a pin that extends substantially parallel with the axis of the turret in a direction from a main body portion of the collar towards the base portion of the turret assembly.

6. The turret as claimed in claim 5, in which the collar has a shield that extends from the main body portion of the collar, the pin being shielded in a radial direction by the shield.

7. The turret as claimed in claim 2, in which the main body portion of the collar is a ring that extends fully around the adjustment mechanism, and the shield is a skirt that extends from an outer periphery of said ring in a direction towards the base portion of the turret assembly.

8. The turret as claimed in claim 7, in which the skirt of the substantially annular mount extends coaxially with said ring.

9. The turret as claimed in claim 2, in which the substantially annular mount comprises at least one fixing member for releasably securing said mount to a radially outwards surface of the adjustment mechanism.

10. The turret as claimed in claim 9, in which said fixing member is a grub screw that extends radially inwards from an aperture in a circumferentially extending surface of the substantially annular mount to bear on said radially outwards surface.

11. The turret as claimed in claim 1, in which the turret knob is removeably secured to the adjustment mechanism and the adjustment mechanism is provided with a series of grip features extending around a rim of the adjustment mechanism by which a user may, in use, grip said rim to rotate the adjustment mechanism to make a sighting adjustment when the turret knob is removed from the adjustment mechanism.

12. The turret as claimed in claim 1, in which the substantially annular main body of the movement limit member is ring-shaped.

13. The turret as claimed in claim 1, in which the substantially annular main body of the movement limit member is seated on an annular ledge extending around the adjustment mechanism.

14. The turret as claimed in claim 13, in which the base portion of the turret assembly is in the shape of an upwardly facing cup in which the adjustment mechanism is rotationally seated, said cup having a rim, said rim being radially outwards from said annular ledge.

15. The turret as claimed in claim 14, in which said rim is axially offset with respect to said ledge to provide a clearance gap with the substantially annular main body of the movement limit member.

16. The turret as claimed in claim 14, in which the first stop member is mounted to a supporting portion of said rim.

17. The turret as claimed in claim 1, in which the first stop member is radially outwards with respect to the second stop member.

18. The turret as claimed claim 1, in which the lug extends both axially and radially away from said main body of the movement limit member.

19. The turret as claimed in claim 1, in which the first and second sides of the lug present respective first and second abutment surfaces, said abutment surfaces being oriented, substantially, in opposite rotational directions of the movement limit member.

20. The turret as claimed in claim 1, in which the first and second stop members present respective first and second stop surfaces, said stop surfaces being oriented, respectively, in opposite circumferential directions.

21. The turret as claimed in claim 1, in which the first side of the lug presents a first common face for contacting, at a first limit of rotation, the first stop member and for contacting, at a second limit of rotation opposite to the first limit of rotation, the second stop member.

22. The turret as claimed in claim 1, in which the second side of the lug presents a second common face for contacting, at a first limit of rotation, the second stop member and for contacting, at a second limit of rotation opposite to the first limit of rotation, the first stop member.

23. The turret as claimed in claim 1, in which the turret knob comprises a cap portion and a turret skirt that depends axially from a periphery of the cap portion.

24. The turret as claimed in claim 23, in which the first stop member is a pin that extends substantially parallel with the axis of the turret in a direction from the base portion of the turret assembly towards the cap portion of the turret knob.

25. The turret as claimed in claim 23, in which the adjustment mechanism comprises an axially slideable member that is movable between a raised orientation and a lowered orientation.

26. The turret as claimed in claim 25, in which the cap portion of the turret knob is removeably mounted to the axially slideable member, wherein the skirt of the turret knob and the base portion of the turret assembly have therebetween matching formations which, in use, inter-engage to lock the turret knob against rotation when the turret knob is depressed to cause the axially slideable member to be in the lowered orientation, and which disengage to free rotationally the turret knob when the turret knob is pulled up to cause the axially slideable member to be in the raised orientation.

27. The turret as claimed in claim 2, in which:

the cap portion of the turret knob is removeably mounted to the axially slideable member, wherein the skirt of the turret knob and the base portion of the turret assembly have therebetween matching formations which, in use, inter-engage to lock the turret knob against rotation when the turret knob is depressed to cause the axially slideable member to be in the lowered orientation, and which disengage to free rotationally the turret knob when the turret knob is pulled up to cause the axially slideable member to be in the raised orientation; and the axially slideable member when in the lowered orientation overlaps said annular mount thereby limiting axial movement of the annular mount away from the base portion of the turret assembly when the annular mount is rotationally released from the adjustment mechanism.

28. The turret as claimed in claim 1, in which the turret knob is removeably attached to the adjustment mechanism, the configuration of the turret knob and the adjustment mechanism being such that:

when the turret knob is attached to the adjustment mechanism, the turret knob protectively conceals the adjustment mechanism; and when the turret knob is removed from the adjustment mechanism, access is provided to the zero-stop mechanism for a user to rotationally disengage the second stop member from the adjustment mechanism whereby, in use, a zero-stop rotational position of the adjustment mechanism can be set, after sighting in of the turret.

29. A telescopic sight comprising:

an elongate external housing of generally cylindrical shape providing a sealed enclosure for optical components held within the housing between opposite objective and eyepiece ends of the housing, said optical components comprising an adjustable sighting assembly;

a turret mounted externally on a central portion of the housing, the turret comprising a turret assembly and affixed externally to the turret assembly a turret knob, wherein:

the turret assembly comprises:

a base portion, the base portion having a seat for fixing the turret assembly to an aperture in a housing of a telescopic sight;

a plunger extending along an axis of the turret within the base portion of the turret assembly, and being movable along said axis to actuate a movable member of the adjustable sighting assembly within said housing;

an adjustment mechanism linked to the plunger, the adjustment mechanism being rotateably mounted to the base portion and being configured, in use, to drive axial movement of the plunger along said axis; and the turret knob is removeably affixed externally to the turret assembly whereby the turret knob when affixed to the turret assembly is attached to the adjustment mechanism whereby, in use, a user can turn the turret knob to effect rotation of the adjustment mechanism in opposite first and second rotational directions, to move the plunger axially in opposite first and second axial directions by manually turning the turret knob in corresponding rotational directions;

wherein the turret assembly further comprises a zero-stop mechanism for limiting the rotation of the adjustment mechanism in both rotational directions, wherein the zero-stop mechanism comprises:

a first stop member for limiting rotation of the adjustment mechanism, the first stop member being fixed to the base portion;

a second stop member for limiting rotation of the adjustment mechanism, the second stop member being releasably secured to the adjustment mechanism whereby the second stop member when secured to the adjustment mechanism is rotationally carried by rotational movement of the adjustment mechanism and when released from the adjustment mechanism is freed from being carried by said rotational movement;

a movement limit member extending around the turret assembly, the movement limit member comprising: (i) a substantially annular main body, said main body being rotatable about said axis with respect to both the base portion and the adjustment mechanism; and (ii) a lug extending away from said main body and being guided by said rotation of said main body along a circular path, and the lug having a first side and opposite the first side, a second side, and wherein, the configuration of the lug, the first stop member and the second stop member when rotationally secured to the adjustment mechanism is such that:

in the first rotational direction the second stop member comes into contact with the first side of the lug whereby said main body is rotated in the first rotational direction by the lug as the lug is moved along the circular path by the second stop member until the second side of the lug comes into contact with the first stop member, thereby limiting the rotation of the adjustment mechanism in the first rotational direction; and in the second rotational direction, the second stop member comes into contact with the second side of the lug whereby said main body is rotated in the second rotational direction by the lug as the lug is moved along the circular path until the first side of the lug comes into contact with the first stop member, thereby limiting the rotation of the adjustment mechanism in the second rotational direction;

and wherein, the configuration of the lug, the first stop member and the second stop member when rotationally released from the adjustment mechanism is such that the adjustment mechanism is freed from said rotational limits of the zero-stop mechanism.

30. A method of setting a zero-stop to limit the rotation in both directions of rotation of an adjustment mechanism of a turret for a telescopic sight, the turret being as claimed in claim 1, and the method comprising:

removing the turret knob from the turret assembly;

releasing the second stop member from the adjustment mechanism so that the second stop member is freed from being carried by rotational movement of the adjustment mechanism;

making a desired sighting adjustment of a telescopic scope;

adjusting the rotational position of the second stop member with respect to the adjustment mechanism in either the first direction of rotation or the second direction of rotation until the first side of the lug comes into contact with one of the first and second stop members and the second side of the lug comes into contact with the other one of the first and second stop members;

securing the second stop member to the adjustment mechanism so that the second stop member will rotate in unison with the adjustment mechanism about the axis of the turret and thereby setting in one direction of rotation a first rotation limit corresponding to the desired sighting adjustment, a second rotation limit in the other direction of rotation being set by contact between the lug and both the first and second stop members after more than one full turn of the adjustment mechanism and less than two full turns of the adjustment mechanism; and affixing the turret knob to the turret assembly.

31. A method of setting a zero-stop of a sighting adjustment turret to limit an adjustment range of a sighting element of a telescopic sight, said turret comprising a turret assembly and a turret knob removeably affixed externally to the turret assembly, the turret assembly comprising:

a base portion fixed to said telescopic sight;

an adjustment mechanism that is rotatable in opposite first and second rotational directions around a turret axis and which is linked to a plunger that is movable in opposite first and second axial directions in response to rotation of the adjustment mechanism in, respectively, said first and second rotational directions; and a zero-stop mechanism for limiting the rotation of the adjustment mechanism in both directions of rotation, the zero-stop mechanism comprising a first stop member fixed to said fixed base portion, a second stop member removeably affixed to the adjustment member, and a movement limit member extending around the adjustment mechanism and comprising a substantially annular main body and a lug extending away from said main body, the lug comprising first and second sides facing, respectively, in opposite rotational directions;

wherein the method comprises:

removing the turret knob from the turret assembly;

releasing the second stop member from the adjustment mechanism so that the second stop member is freed from being carried by rotational movement of the adjustment mechanism;

making a desired sighting adjustment of a telescopic scope;

adjusting the rotational position of the second stop member with respect to the adjustment mechanism in either the first direction of rotation or the second direction of rotation until the first side of the lug comes into contact with one of the first and second stop members and the second side of the lug comes into contact with the other one of the first and second stop members;

securing the second stop member to the adjustment mechanism so that the second stop member will rotate in unison with the adjustment mechanism about the axis of the turret and thereby setting in one of said rotational direction a first rotation limit corresponding to the desired sighting adjustment, a second rotation limit in the other rotational direction being set by contact between the lug and both the first and second stop members after more than one full turn of the adjustment mechanism and less than two full turns of the adjustment mechanism; and affixing the turret knob to the turret assembly.

* * * * *